US010944196B2

(12) United States Patent
Ou

(10) Patent No.: US 10,944,196 B2
(45) Date of Patent: Mar. 9, 2021

(54) ELECTRICAL CONNECTOR

(71) Applicant: LOTES CO., LTD, Keelung (TW)

(72) Inventor: Zi Sheng Ou, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/689,307

(22) Filed: Nov. 20, 2019

(65) Prior Publication Data

US 2020/0169024 A1 May 28, 2020

(30) Foreign Application Priority Data

Nov. 28, 2018 (CN) ..... 201811432882.3

(51) Int. Cl.

| | |
|---|---|
| ***H01R 13/24*** | (2006.01) |
| ***H01R 12/55*** | (2011.01) |
| ***H01R 12/70*** | (2011.01) |
| ***H01R 13/41*** | (2006.01) |

(52) U.S. Cl.

CPC ..... *H01R 13/2457* (2013.01); *H01R 12/55* (2013.01); *H01R 12/7076* (2013.01); *H01R 13/41* (2013.01)

(58) Field of Classification Search

CPC ..... H01R 13/2457; H01R 12/55; H01R 12/7076; H01R 13/41; H01R 13/2435; H01R 12/714; H01R 13/245

See application file for complete search history.

(56) References Cited

U.S. PATENT DOCUMENTS

| | | | | |
|---|---|---|---|---|
| 6,113,440 | A * | 9/2000 | Fijten | H01R 13/2492 439/862 |
| 6,315,621 | B1 * | 11/2001 | Natori | H01R 13/2428 439/862 |
| 7,014,477 | B2 * | 3/2006 | Tsai | H01R 13/2442 439/331 |
| 7,297,010 | B2 * | 11/2007 | Tsai | H01R 13/2442 439/331 |

(Continued)

FOREIGN PATENT DOCUMENTS

| | | |
|---|---|---|
| CN | 1144323 C | 3/2004 |
| CN | 2932685 Y | 8/2007 |

(Continued)

*Primary Examiner* — Renee S Luebke
*Assistant Examiner* — Paul D Baillargeon
(74) *Attorney, Agent, or Firm* — Locke Lord LLP; Tim TingKang Xia, Esq.

(57) ABSTRACT

An electrical connector includes an insulating body and multiple conductive terminals. Each conductive terminal has: a main body portion; an elastic arm bending and extending upward from the main body portion; a through slot running through the elastic arm, forming a first elastic arm and a second elastic arm at two opposite sides thereof; and a contact portion bending and extending upward from the elastic arm. A width of the first elastic arm is greater than a width of the second elastic arm. The contact portion defines a virtual center line along an extending direction thereof. A gap between an inner side wall of the first elastic arm on a side thereof adjacent to the through slot and the center line is smaller than a gap between an inner side wall of the second elastic arm on a side thereof adjacent to the through slot and the center line.

14 Claims, 11 Drawing Sheets

(56) References Cited

U.S. PATENT DOCUMENTS

| | | | | |
|---|---|---|---|---|
| 7,341,485 | B2 * | 3/2008 | Polnyi | H01R 13/2435 439/591 |
| 7,559,811 | B1 * | 7/2009 | Polnyi | H01R 4/4809 439/591 |
| 7,563,105 | B2 * | 7/2009 | Liu | H01R 13/2492 439/66 |
| 10,276,953 | B2 * | 4/2019 | Huang | H01R 12/57 |
| 10,424,858 | B2 * | 9/2019 | Ju | H01R 43/16 |
| 2018/0331441 | A1 * | 11/2018 | Huang | H01R 12/716 |

FOREIGN PATENT DOCUMENTS

| | | | |
|---|---|---|---|
| CN | 201122684 | Y | 9/2008 |
| CN | 207282768 | U | 4/2018 |
| TW | M373036 | U | 1/2010 |

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201811432882.3 filed in China on Nov. 28, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector having conductive terminals that improve high-frequency performance thereof.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector mainly includes a plurality of conductive terminals fixed to an insulating body to electrically connect a chip module to a circuit board. The basic structure of each conductive terminal includes a main body portion, an elastic arm and a contact portion. Each conductive terminal is fixed to the insulating body through the main body portion. The elastic arm bends and extends upward from the main body portion. A through slot runs through the elastic arm such that the elastic arm forms a first elastic arm and a second elastic arm having a same width at two opposite sides of the through slot. The contact portion is formed by connecting the first elastic arm and the second elastic arm and extending upward to abut the chip module.

However, in recent years, the requirements for high-frequency performance of an electrical connector become higher. The impedance of the structures of the conductive terminals of a conventional electrical connector is difficult to achieve impedance matching when transmitting high-frequency signals, which easily leads to high-frequency resonance and generate high-frequency noise, and it is difficult to meet the performance requirements of transmitting high-frequency signals.

Therefore, a heretofore unaddressed need to design a new electrical connector exists in the art to address the aforementioned deficiencies and inadequacies.

SUMMARY

The present invention is directed to provide an electrical connector having a conductive terminal that adjusts a terminal characteristic impedance to improve high-frequency performance.

In order to achieve the foregoing objective, the present invention adopts the following technical solutions:

An electrical connector is configured to be electrically connected to a chip module. The electrical connector includes: an insulating body; and a plurality of conductive terminals, correspondingly accommodated in the insulating body respectively, wherein each of the conductive terminals has: a main body portion, fixed in the insulating body; an elastic arm, located above the main body portion; a through slot, running through the elastic arm, such that the elastic arm forms a first elastic arm and a second elastic arm at two opposite sides of the through slot, wherein a width of the first elastic arm is greater than a width of the second elastic arm, the first elastic arm has a first inner side wall on a side thereof adjacent to the through slot, and the second elastic arm has a second inner side wall on a side thereof adjacent to the through slot; and a contact portion, formed by bending and extending upward from the elastic arm, wherein the contact portion defines a virtual center line along an extending direction thereof, and a gap between the first inner side wall and the virtual center line is smaller than a gap between the second inner side wall and the virtual center line.

In certain embodiments, the through slot extends downward to the main body portion.

In certain embodiments, a first bending portion is provided between the first elastic arm and the main body portion, and a second bending portion is provided between the second elastic arm and the main body portion.

In certain embodiments, the width of the first elastic arm is greater than a width of the first bending portion, and the width of the second elastic arm is equal to a width of the second bending portion.

In certain embodiments, a beam is connected to the first elastic arm and the second elastic arm.

In certain embodiments, the contact portion comprises a first contact portion and a second contact portion, the second contact portion is formed by extending backward from the beam, and the first contact portion is formed by extending backward from the second contact portion.

In certain embodiments, the first contact portion is located higher than the second contact portion, when the chip module starts pressing downward, the chip module is in contact with the first contact portion, and when the pressing stops, the first contact portion is separated from the chip module and the second contact portion is in contact with the chip module.

In certain embodiments, a third elastic arm extends upward from the main body portion, the third elastic arm and the second elastic arm are located at a same side of the elastic arm, a through hole is formed between the third elastic arm and the second elastic arm, and the beam is connected to the third elastic arm.

In certain embodiments, a width of the third elastic arm is equal to the width of the second elastic arm.

In certain embodiments, a strip connecting portion extends upward from the main body portion, and the strip connecting portion and the first elastic arm are located at a same side of the elastic arm.

In certain embodiments, a groove is provided between the strip connecting portion and the first elastic arm, and a depth of the through slot extending on the main body portion is greater than a depth of the groove extending on the main body portion.

In certain embodiments, a soldering portion is provided and extends downward from the main body portion, the soldering portion has two clamping portions, projections of the two clamping portions onto a horizontal surface have a symmetrical virtual center line, and a virtual center line of a projection of the contact portion onto the horizontal surface and the symmetrical virtual center line are located on a same vertical line.

Compared with the related art, the electrical connector according to certain embodiments of the present invention have the following beneficial effects.

By setting the width of the first elastic arm to be greater than the width of the second elastic arm at the two sides of the through slot, and by increasing the width of the first elastic arm, the impedance of each conductive terminal is reduced, thereby improving the high-frequency performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
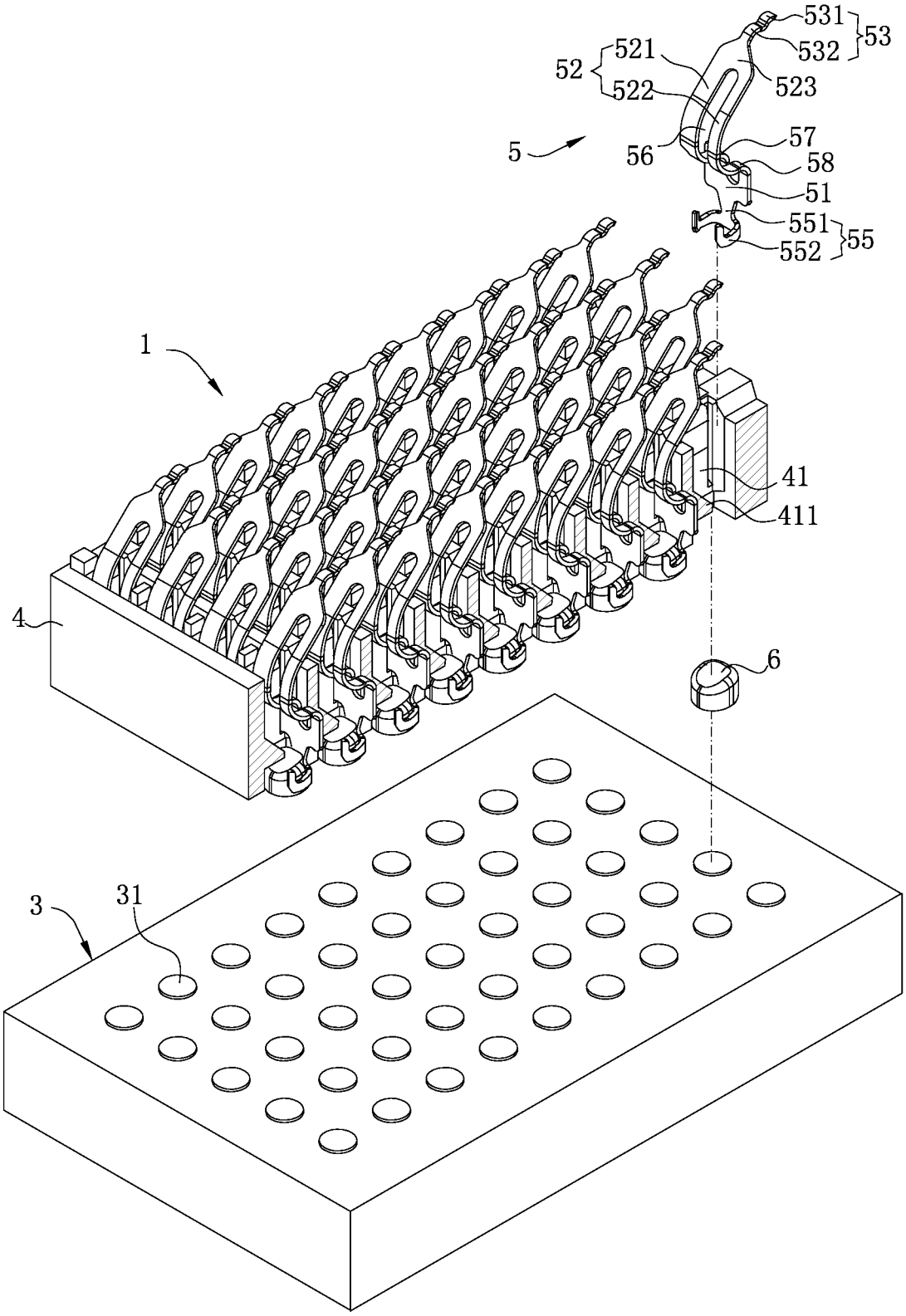
FIG. 1 is a partial perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

Figure 2:
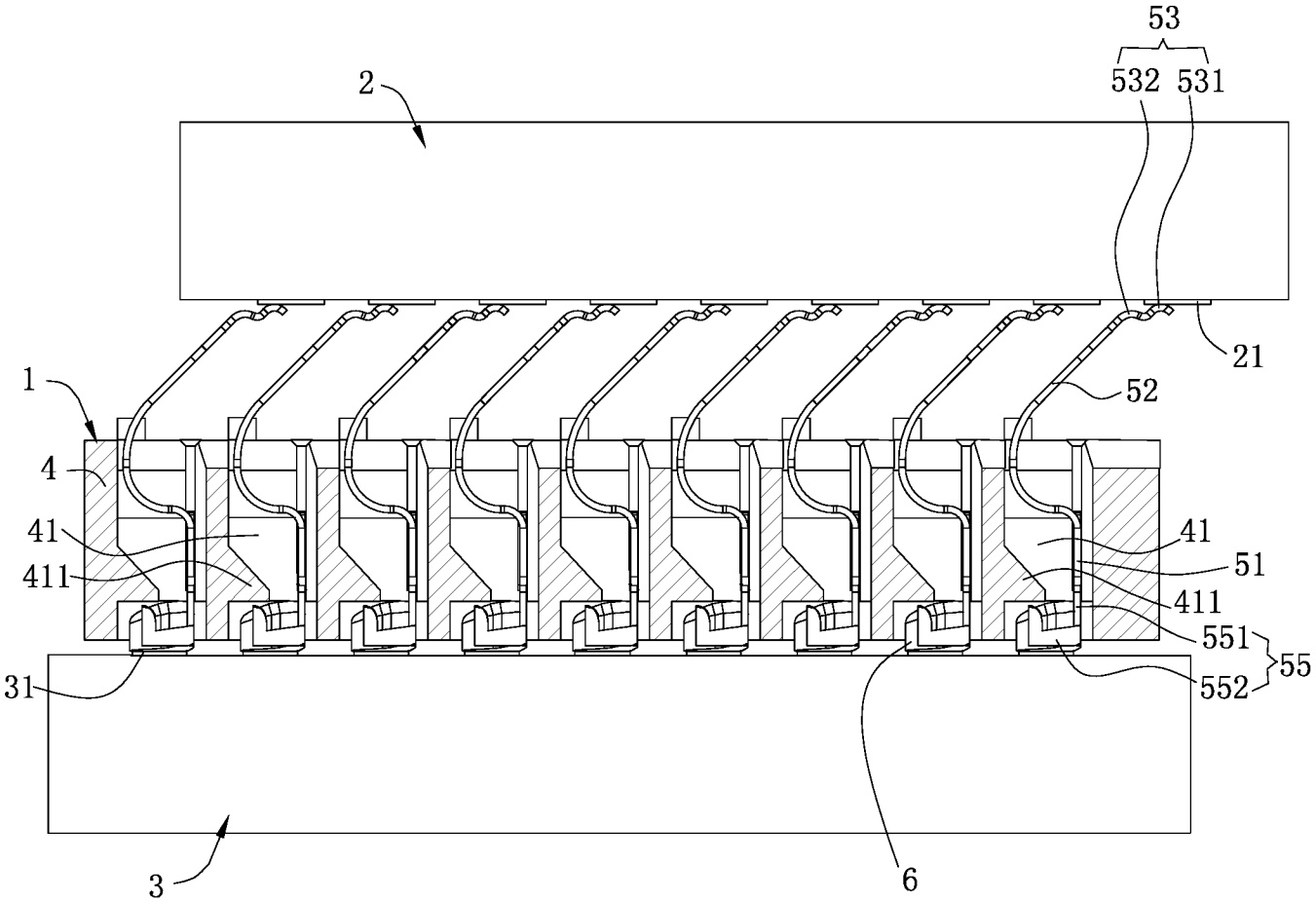
FIG. 2 is a sectional view of the electrical connector according to the first embodiment of the present invention when the chip module starts pressing downward.
Figure 3:
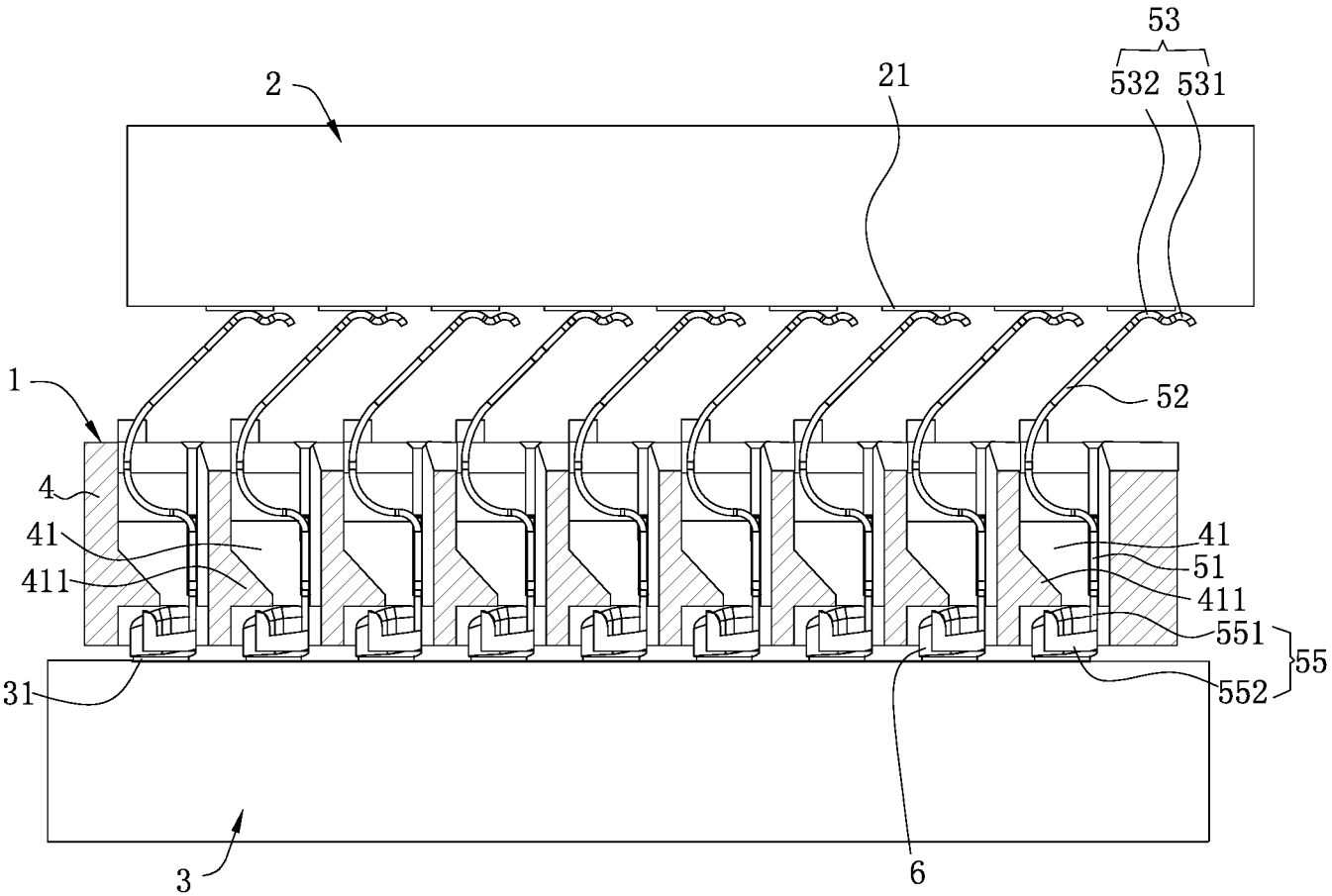
FIG. 3 is a sectional view of the electrical connector according to the first embodiment of the present invention when the chip module stops pressing downward.

FIG. 1 to FIG. 3 show an electrical connector 1 according to a first embodiment of the present invention. The electrical connector 1 is used to electrically connect a chip module 2 to a circuit board 3. The electrical connector 1 includes an insulating body 4 and a plurality of conductive terminals 5 correspondingly accommodated in the insulating body 4. An upper end of each of the conductive terminals 5 elastically abuts the chip module 2, and a lower end thereof is soldered to the circuit board 3 through a solder 6. The chip module 2 is provided with a plurality of connection points 21, and each of the connection point 21 is used to abut the upper end of a corresponding conductive terminal 5. The circuit board 3 is provided with a plurality of conductive pads 31, and each of the conductive pads 31 is used to be soldered with the lower end of a corresponding conductive terminal 5.

As shown in FIG. 1 to FIG. 3, the insulating body 4 is made of an insulating material. The insulating body 4 is provided with a plurality of terminal accommodating holes 41 arranged in a matrix and running through the insulating body 4 vertically. One side surface of each terminal accommodating hole 41 is provided with a protruding block 411 to limit a corresponding conductive terminal 5 from moving upward during the soldering process.

Figure 4:
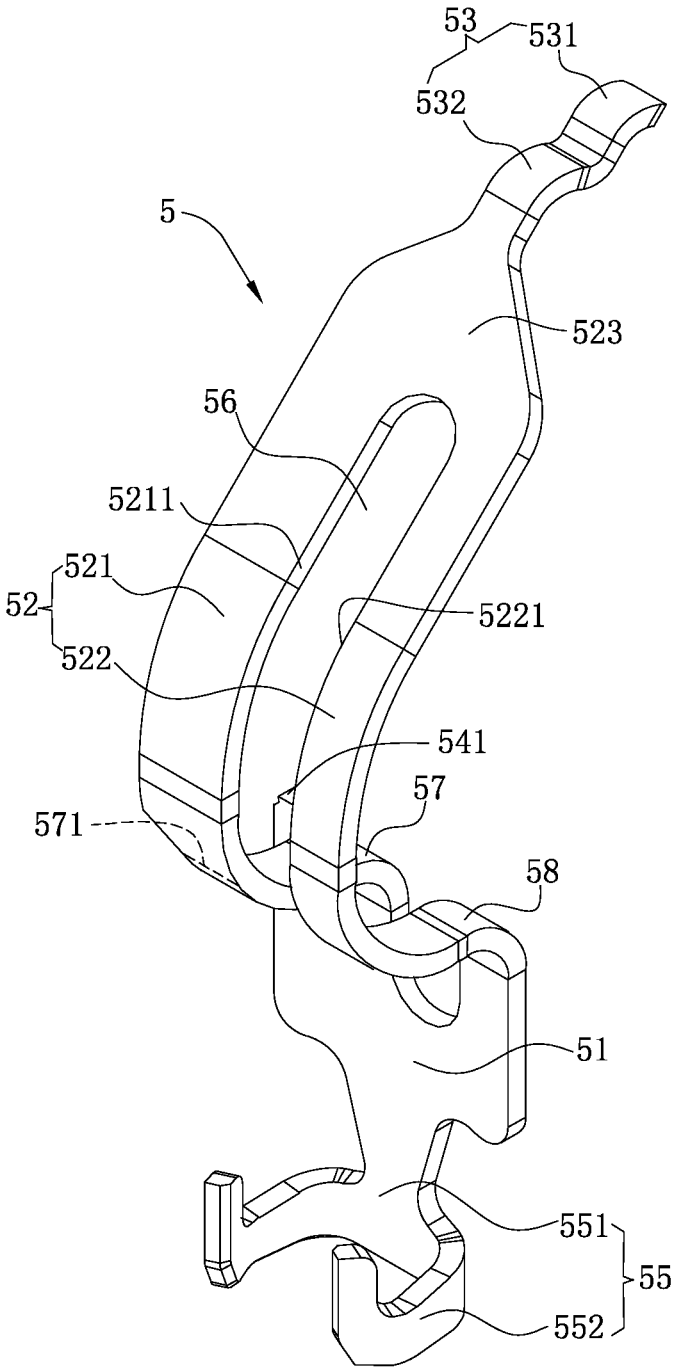
FIG. 4 is an enlarged perspective view of a conductive terminal of the electrical connector according to the first embodiment of the present invention.
Figure 5:
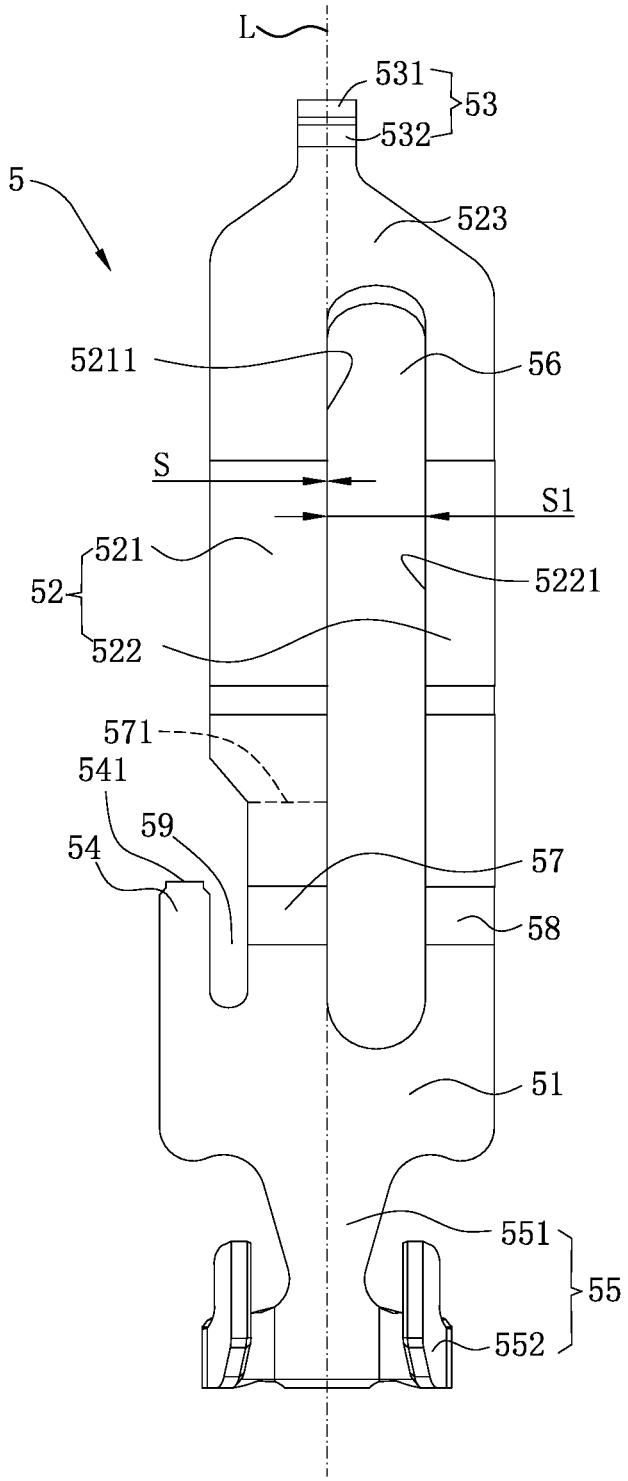
FIG. 5 is a front view of FIG. 4.
Figure 6:
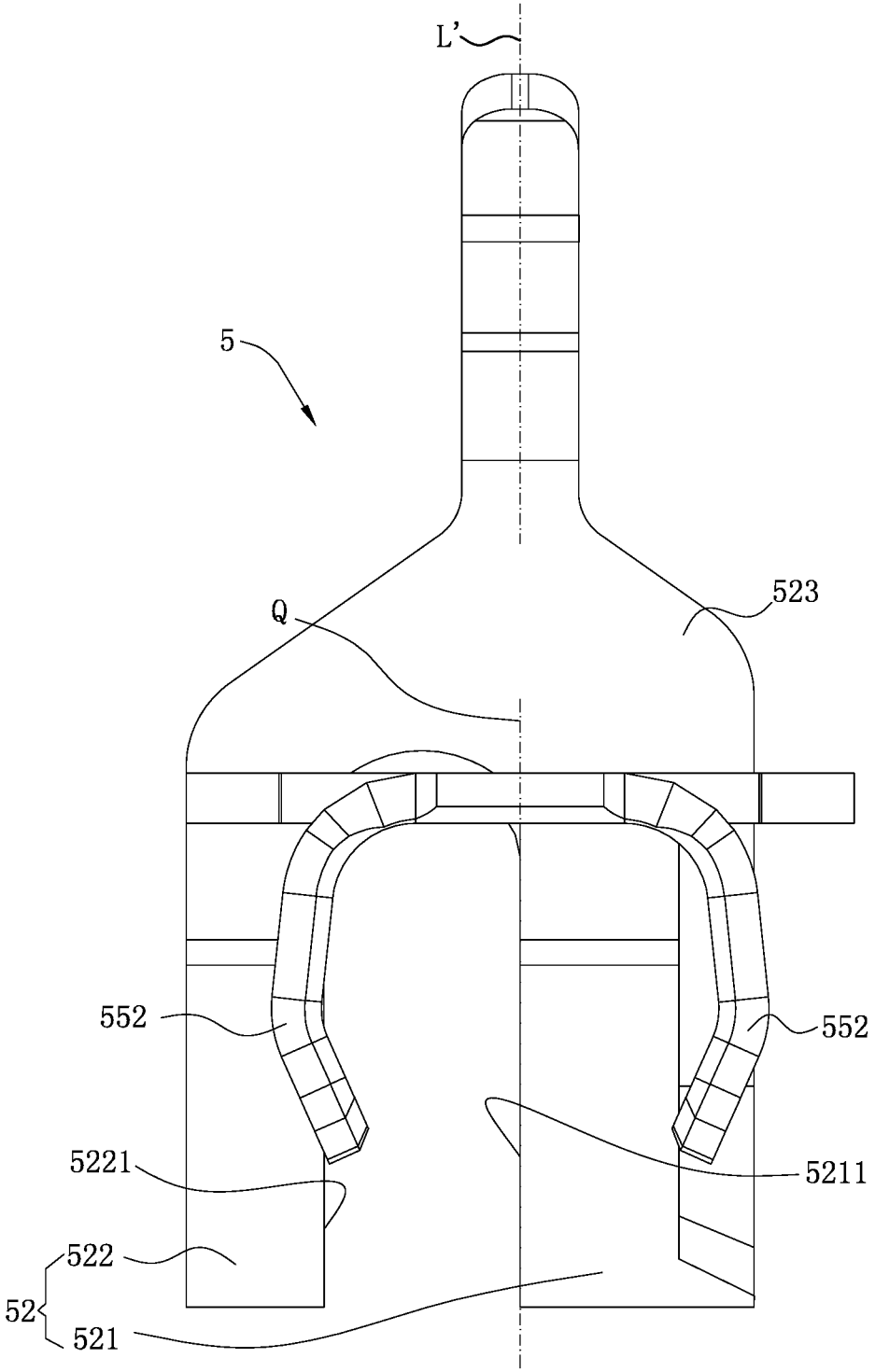
FIG. 6 is a schematic view of the conductive terminal of FIG. 4 viewing upward from bottom thereof.

As shown in FIG. 3 to FIG. 5, the conductive terminals 5 are correspondingly accommodated in the terminal accommodating holes 41 of the insulating body 4. Each of the conductive terminals 5 is formed by stamping a metal plate, and each conductive terminal 5 has a main body portion 51, an elastic arm 52, a contact portion 53, a strip connecting portion 54 and a soldering portion 55.

As shown in FIG. 3 to FIG. 5, the main body portion 51 is fixed in the insulating body 4, and the main body portion 51 is a vertical flat plate. The elastic arm 52 is located above the main body portion 51. The through slot 56 runs through the elastic arm 52 such that the elastic arm 52 forms a first elastic arm 521 and a second elastic arm 522 at two opposite sides of the through slot 56. A width of the first elastic arm 521 is greater than a width of the second elastic arm 522. The through slot 56 extends downward to the main body portion 51, thereby increasing the length of the through slot 56 on the elastic arm 52 to a maximum degree, and increasing the elasticity of the elastic arm 52. A first bending portion 57 is provided between the first elastic arm 521 and the main body portion 51, and a second bending portion 58 is provided between the second elastic arm 522 and the main body portion 51. The first bending portion 57 has an upper end 571. The width of the first elastic arm 521 is greater than a width of the first bending portion 57, and the width of the second elastic arm 522 is equal to a width of the second bending portion 58. The first elastic arm 521 has a first inner side wall 5211 on a side thereof adjacent to the through slot 56, and the second elastic arm 522 has a second inner side wall 5221 on a side thereof adjacent to the through slot 56.

By setting the width of the first elastic arm 521 to be greater than the width of the second elastic arm 522 at the two sides of the through slot 56, and by increasing the width of the first elastic arm 521, the impedance of each conductive terminal 5 is reduced, thereby improving the high-frequency performance of the electrical connector 1.

As shown in FIG. 2 to FIG. 5, a beam 523 connects the first elastic arm 521 and the second elastic arm 522. A contact portion 53 is formed by bending and extending upward from the beam 523 to abut a corresponding connection point 21 of the chip module 2. The contact portion 53 defines a virtual center line L along the extending direction thereof, and a first gap S between the first inner side wall 5211 and the virtual center line L is smaller than a second gap S1 between the second inner side wall 5221 and the virtual center line L. In this embodiment, the first gap S between the first inner side wall 5211 and the center line L is zero. Further, the contact portion 53 includes a first contact portion 531 and a second contact portion 532. The second contact portion 532 is formed by extending backward from the beam 523, and the first contact portion 531 is formed by extending backward from the second contact portion 532. The first contact portion 531 has a free tail end. The first contact portion 531 is located higher than the second contact portion 532.

As shown in FIG. 2 and FIG. 3, in the process of mounting the chip module 2, when the chip module 2 starts pressing downward, the chip module 2 is in contact with the first contact portion 531 of each conductive terminal 5. As shown in FIG. 3, as the chip module 2 further presses downward, the contact portion 53 together with the elastic arm 52 of each conductive terminal 5 deform by bending downward. At this time, the contact position of each conductive terminal 5 and the chip module 2 slides from the original first contact portion 531 to the second contact portion 532 in the operating state, and the first contact portion 531 is separated from the chip module 2. Thus, the movement of the contact position of each conductive terminal 5 and the chip module 2 in the horizontal direction is greatly reduced, the conductive terminals 5 do not deviate from the connection points 21 due to the large movements of the contact portions 53 thereof on the chip module 2 to cause poor contacts, and the length of the elastic arm 52 of each conductive terminal 5 is also not greatly limited by the movement or deviation of the contact portion 53 being too large.

As shown in FIG. 4 and FIG. 5, the strip connecting portion 54 further extends upward from the main body portion 51 to be connected to a strip (not shown). The strip connecting portion 54 has an upper end 541, and the upper end 571 of the first bending portion 57 is higher than the upper end 541 of the strip connecting portion 54. The strip connecting portion 54 and the first elastic arm 521 are located at a same side of the elastic arm 52. A groove 59 is provided between the strip connecting portion 54 and the first elastic arm 521, and a depth of the through slot 56 extending on the main body portion 51 is greater than a depth of the groove 59 extending on the main body portion 51.

As shown in FIG. 3 to FIG. 6, a soldering portion 55 extends downward from the main body portion 51 to be electrically connected to the circuit board 3. The soldering portion 55 includes a connecting portion 551 formed by vertically extending downward from the main body portion 51 and two clamping portions 552 respectively formed by bending and extending from the two opposite sides of the connecting portion 551. The protruding block 411 on the corresponding terminal accommodating hole 41 stops the two clamping portions 552 to limit each conductive terminal 5 from moving upward during the soldering process. The two clamping portions 552 jointly clamp the solder 6 for soldering each conductive terminal 5 to the corresponding conductive pad 31 through the solder 6. Projections of the two clamping portions 552 onto a horizontal surface have a symmetrical virtual center line Q. A virtual center line L' of a projection of the contact portion 53 onto the horizontal surface and the symmetrical virtual center line Q are on a same straight line.

Figure 7:
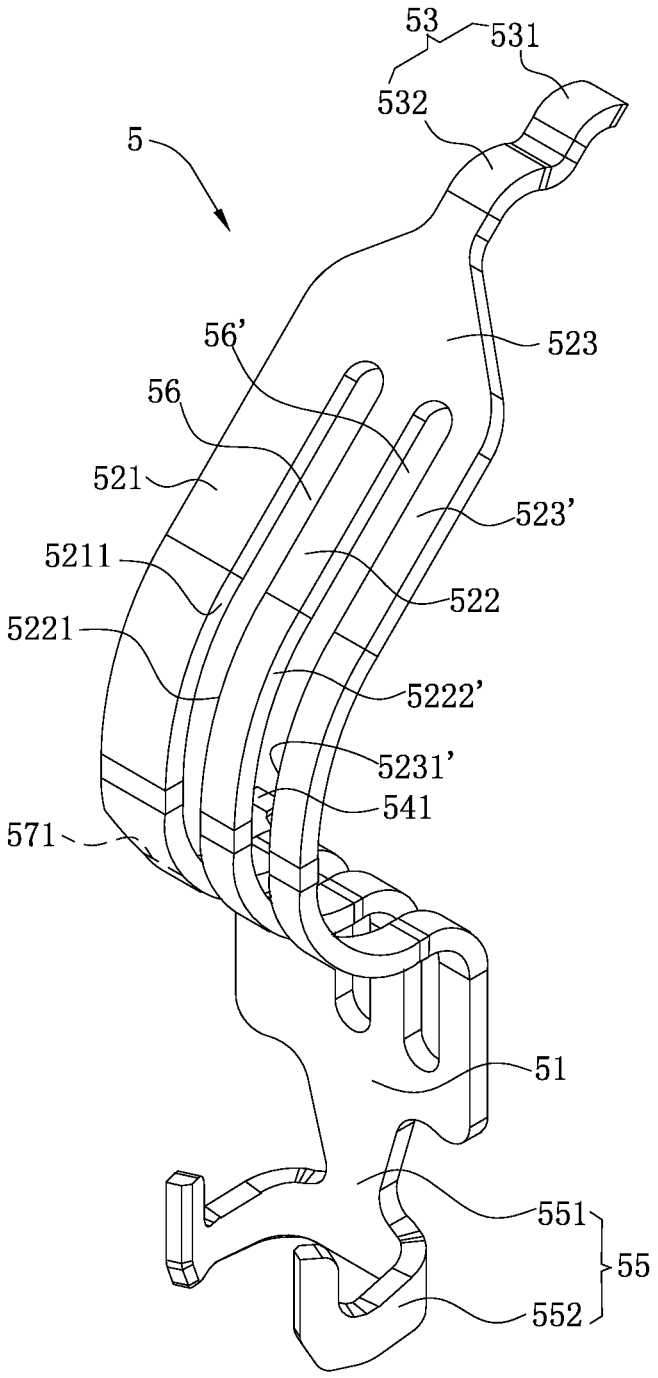
FIG. 7 is an enlarged perspective view of a conductive terminal of an electrical connector according to a second embodiment of the present invention.
Figure 8:
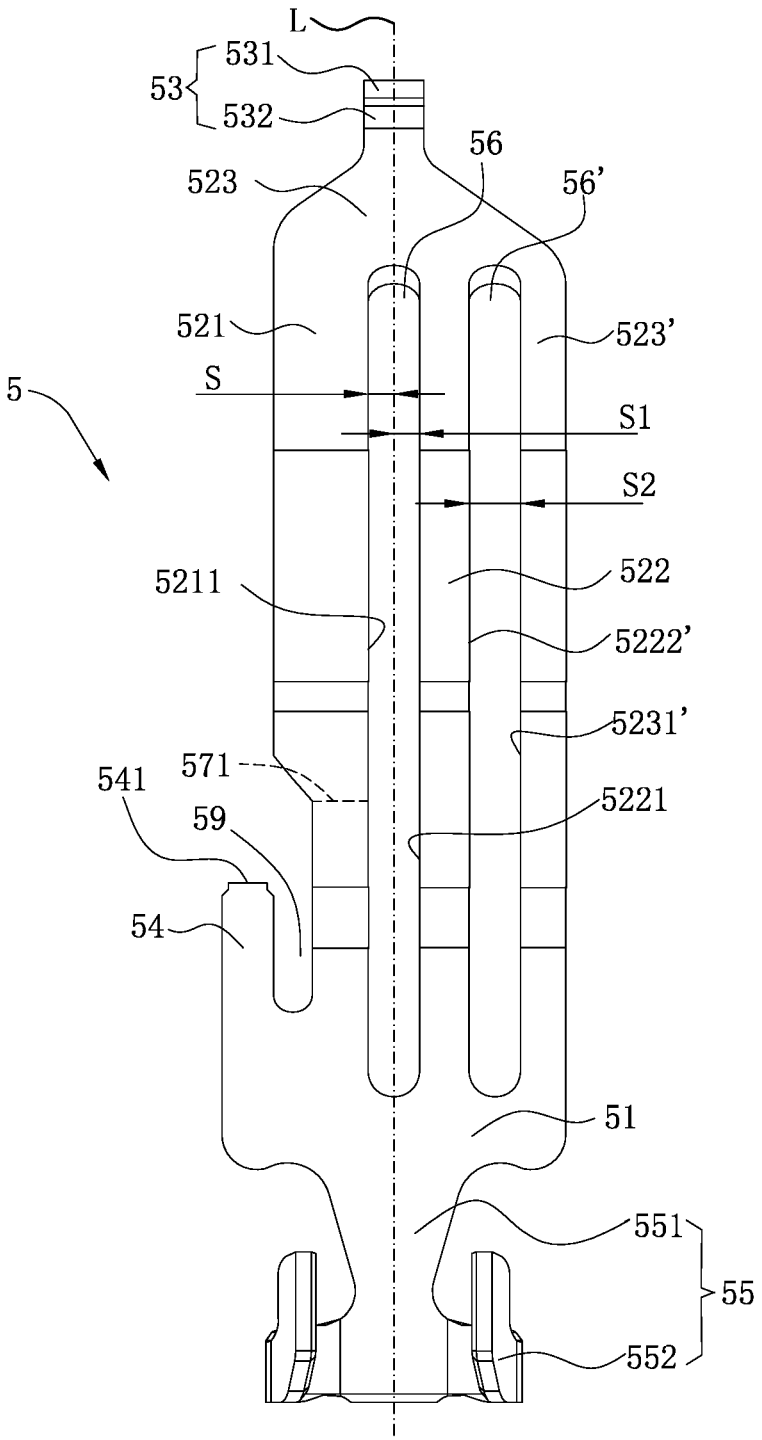
FIG. 8 is a front view of FIG. 7.

FIG. 7 and FIG. 8 show a second embodiment of the present invention, which is different from the first embodiment in that: a third elastic arm 523' extends upward from the main body portion 51. The third elastic arm 523' and the second elastic arm 522 are located at a same side of the elastic arm 52, and a through hole 56' is formed between the third elastic arm 523' and the second elastic arm 522. The structures of the through hole 56' and the through slot 56 are identical. A width of the third elastic arm 523' is equal to the width of the second elastic arm 522, and the beam 523 connects the second elastic arm 522 and the third elastic arm 523'. The second elastic arm 522 has a third inner side wall 5222' at one side thereof adjacent to the third elastic arm 523', and the third elastic arm 523' has a fourth inner side wall 5231' at one side thereof adjacent to the through hole 56'. The first gap S between the first inner side wall 5211 and the virtual center line L is smaller than the sum of the second gap S1 between the second inner sidewall 5221 and the virtual center line L and the third gap S2 between the third inner side wall 5222' and the fourth inner side wall 5231'. Other structures and functions of the second embodiment are completely identical to those of the first embodiment, and thus are not elaborated herein.

Figure 9:
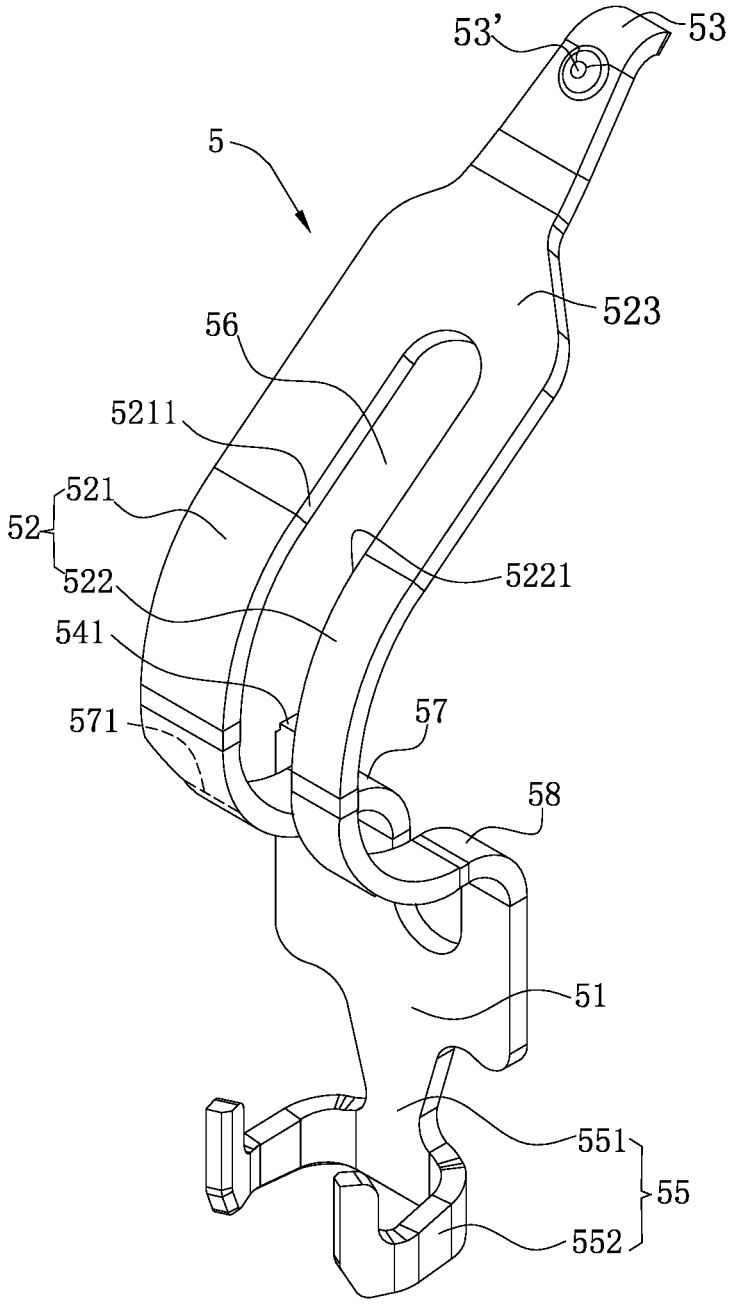
FIG. 9 is an enlarged perspective view of a conductive terminal of an electrical connector according to a third embodiment of the present invention.
Figure 10:
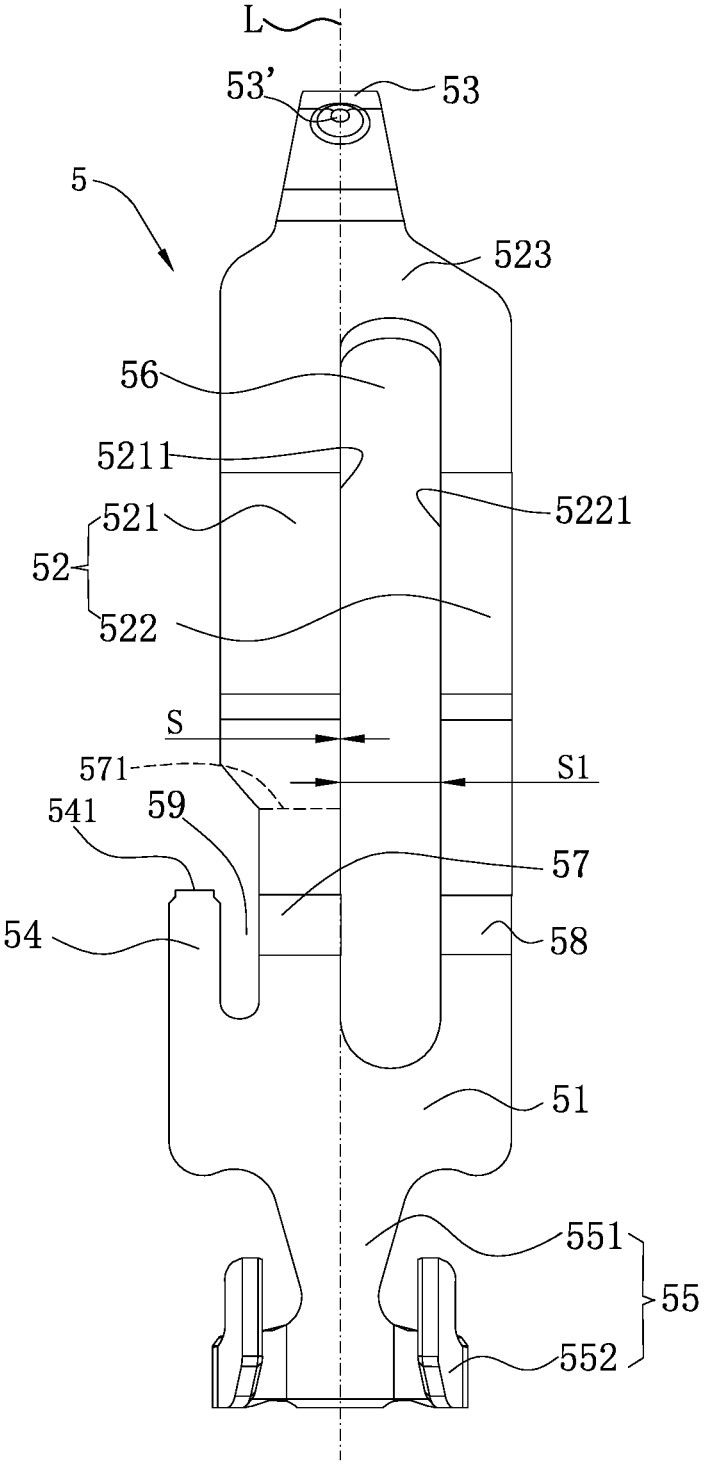
FIG. 10 is a front view of FIG. 9.
Figure 11:
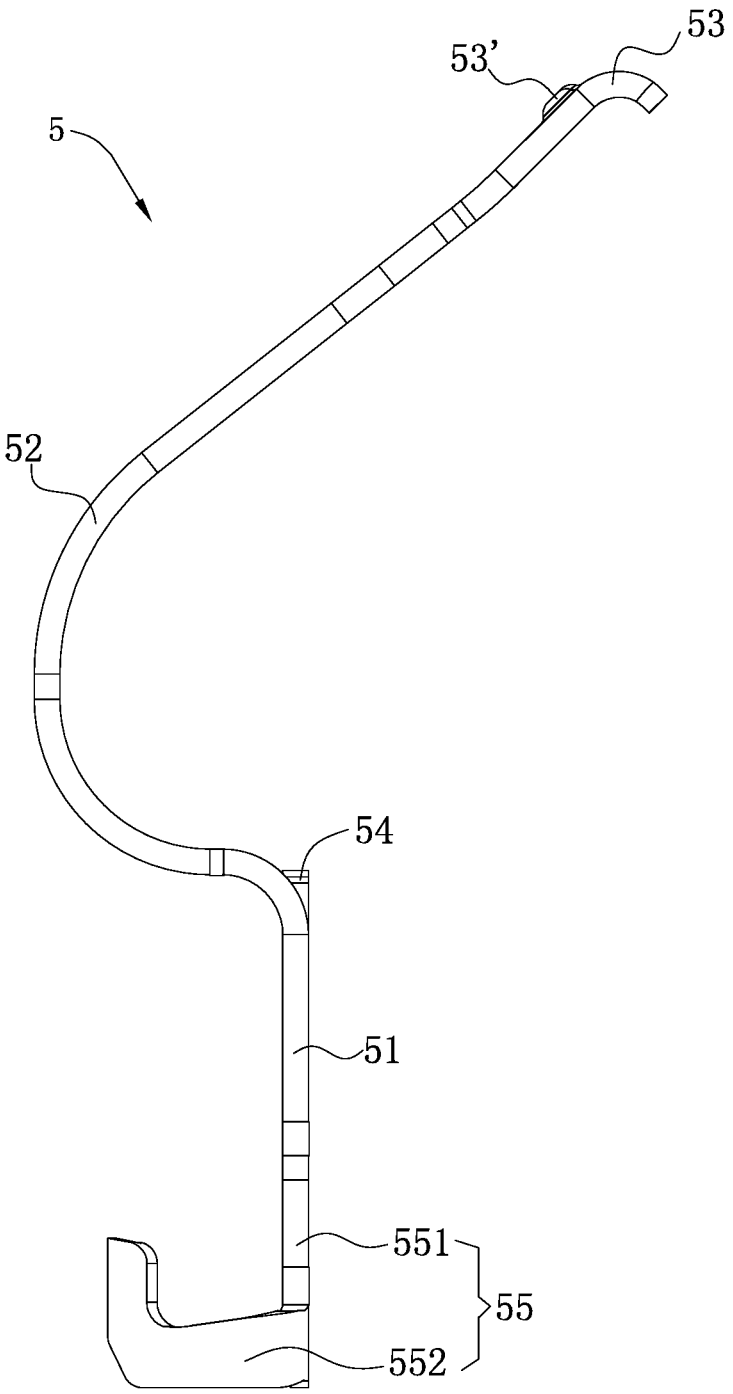
FIG. 11 is a right view of FIG. 9.

FIG. 9 to FIG. 11 show a third embodiment of the present invention, which is different from the first embodiment in that: a protruding point 53' is provided between the contact portion 53 and the beam 523. In the process in which the chip module 2 presses downward, initially, the chip module 2 is in contact with the contact portion 53. As the chip module 2 further presses downward, the contact portion 53 together with the elastic arm 52 of each conductive terminal 5 deform by bending downward. At this time, the contact position of each conductive terminal 5 and the chip module 2 slides from the original contact portion 53 to the protruding point 53' in the operating state, and the contact portion 53 is separated from the chip module 2. Other structures and functions of the third embodiment are completely identical to those of the first embodiment, and thus are not elaborated herein.

To sum up, the electrical connector 1 according to certain embodiments of the present invention has the following beneficial effects:

(1) The through slot 56 runs through the elastic arm 52, such that the elastic arm 52 forms a first elastic arm 521 and a second elastic arm 522 at two opposite sides of the through slot 56, and the width of the first elastic arm 521 is greater than the width of the second elastic arm 522. By increasing the width of the first elastic arm 521, the impedance of each conductive terminal 5 is reduced, thereby improving the high-frequency performance of the electrical connector 1.

(2) The contact portion 53 includes a first contact portion 531 and a second contact portion 532. The second contact portion 532 is formed by extending backward from the beam 523, and the first contact portion 531 is formed by extending backward from the second contact portion 532. The first contact portion 531 has a free tail end. The first contact portion 531 is located higher than the second contact portion 532. When the chip module 2 starts pressing downward, the chip module 2 is in contact with the first contact portion 531. When the pressing is stopped, the first contact portion 531 is separated from the chip module 2 and the second contact portion 532 is in contact with the chip module 2, thereby reducing the sliding movement of the contact position of each conductive terminal 5 and the chip module 2 in the horizontal direction, such that the conductive terminals 5 do not deviate from the connection points 21 due to the large movements of the contact portions 53 thereof on the chip module 2 to cause poor contacts.

(3) Projections of the two clamping portions 552 onto a horizontal surface have a symmetrical virtual center line Q. The virtual center line L' of a projection of the contact portion 53 onto the horizontal surface and the symmetrical virtual center line Q are on a same straight line, thereby reducing the torsion strength at the stress concentration area of each conductive terminal 5.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a chip module, the electrical connector comprising:

an insulating body; and a plurality of conductive terminals, correspondingly accommodated in the insulating body respectively, wherein each of the conductive terminals has:

a main body portion, fixed in the insulating body;

an elastic arm, located above the main body portion;

a through slot, running through the elastic arm, such that the elastic arm forms a first elastic arm and a second elastic arm at two opposite sides of the through slot, wherein the through slot extends downward to the main body portion, a maximum width of the first elastic arm is greater than a maximum width of the second elastic arm, the first elastic arm has a first inner side wall on a side thereof adjacent to the through slot, and the second elastic arm has a second inner side wall on a side thereof adjacent to the through slot; and a contact portion, formed by bending and extending upward from the elastic arm, wherein the contact portion defines a virtual center line along an extending direction thereof, and a gap between the first inner side wall and the virtual center line is smaller than a gap between the second inner side wall and the virtual center line, wherein the first elastic arm has a first bending portion formed by extending upward from the main body portion, the second elastic arm has a second bending portion formed by extending upward from the main body portion, and a width of a portion of the first elastic arm located above the first bending portion is greater than a width of the first bending portion.

2. The electrical connector according to claim 1, wherein a beam is connected to the first elastic arm and the second elastic arm.

3. The electrical connector according to claim 2, wherein a third elastic arm extends upward from the main body portion, the third elastic arm and the second elastic arm are located at a same side of the first elastic arm along a width direction of the first elastic arm, a through hole is formed between the third elastic arm and the second elastic arm, and the beam is connected to the third elastic arm.

4. The electrical connector according to claim 3, wherein a width of the third elastic arm is equal to a width of the second elastic arm.

5. The electrical connector according to claim 1, wherein a strip connecting portion extends upward from the main body portion, the strip connecting portion and the first elastic arm are located at a same side of the second elastic arm along a width direction of the second elastic arm, and an upper end of the first bending portion is located higher than an upper end of the strip connecting portion.

6. The electrical connector according to claim 5, wherein a groove is provided between the strip connecting portion and the first elastic arm, and a depth of the through slot extending on the main body portion is greater than a depth of the groove extending on the main body portion.

7. The electrical connector according to claim 1, wherein a width of the second elastic arm is constant from bottom to top thereof.

8. An electrical connector, configured to be electrically connected to a chip module, the electrical connector comprising:

an insulating body; and a plurality of conductive terminals, correspondingly accommodated in the insulating body respectively, wherein each of the conductive terminals has:

a main body portion, fixed in the insulating body;

an elastic arm, located above the main body portion;

a through slot, running through the elastic arm, such that the elastic arm forms a first elastic arm and a second elastic arm at two opposite sides of the through slot, wherein a maximum width of the first elastic arm is greater than a maximum width of the second elastic arm, the first elastic arm has a first inner side wall on a side thereof adjacent to the through slot, and the second elastic arm has a second inner side wall on a side thereof adjacent to the through slot; and a contact portion, formed by bending and extending upward from the elastic arm, wherein the contact portion defines a virtual center line along an extending direction thereof, and a gap between the first inner side wall and the virtual center line is smaller than a gap between the second inner side wall and the virtual center line, wherein a beam is connected to the first elastic arm and the second elastic arm, the contact portion comprises a first contact portion and a second contact portion, the second contact portion is formed by extending backward from the beam, the first contact portion is formed by extending backward from the second contact portion, the first contact portion is located higher than the second contact portion, when the chip module starts pressing downward, the chip module is in contact with the first contact portion, and when the pressing stops, the first contact portion is separated from the chip module and the second contact portion is in contact with the chip module.

9. The electrical connector according to claim 8, wherein a third elastic arm extends upward from the main body portion, the third elastic arm and the second elastic arm are located at a same side of the first elastic arm along a width direction of the first elastic arm, a through hole is formed between the third elastic arm and the second elastic arm, and the beam is connected to the third elastic arm.

10. The electrical connector according to claim 9, wherein a width of the third elastic arm is equal to a width of the second elastic arm.

11. An electrical connector, configured to be electrically connected to a chip module, the electrical connector comprising:

an insulating body; and a plurality of conductive terminals, correspondingly accommodated in the insulating body respectively, wherein each of the conductive terminals has:

a main body portion, fixed in the insulating body;

an elastic arm, located above the main body portion;

a through slot, running through the elastic arm, such that the elastic arm forms a first elastic arm and a second elastic arm at two opposite sides of the through slot, wherein a maximum width of the first elastic arm is greater than a maximum width of the second elastic arm, the first elastic arm has a first inner side wall on a side thereof adjacent to the through slot, and the second elastic arm has a second inner side wall on a side thereof adjacent to the through slot; and a contact portion, formed by bending and extending upward from the elastic arm, wherein the contact portion defines a virtual center line along an extending direction thereof, and a gap between the first inner side wall and the virtual center line is smaller than a gap between the second inner side wall and the virtual center line, wherein a soldering portion is provided and extends downward from the main body portion, the soldering portion has two clamping portions, projections of the two clamping portions onto a horizontal surface have a symmetrical virtual center line, and a virtual center line of a projection of the contact portion onto the horizontal surface and the symmetrical virtual center line are located on a same vertical line.

12. The electrical connector according to claim 11, wherein a beam is connected to the first elastic arm and the second elastic arm.

13. The electrical connector according to claim 12, wherein a third elastic arm extends upward from the main body portion, the third elastic arm and the second elastic arm are located at a same side of the first elastic arm along a width direction of the first elastic arm, a through hole is formed between the third elastic arm and the second elastic arm, and the beam is connected to the third elastic arm.

14. The electrical connector according to claim 13, wherein a width of the third elastic arm is equal to a width of the second elastic arm.

* * * * *